US010683981B2

(12) United States Patent
Wang et al.

(10) Patent No.: US 10,683,981 B2
(45) Date of Patent: Jun. 16, 2020

(54) LIGHT-TRANSMITTING ELEMENT AND LIGHTING DEVICE INCLUDING THE SAME

(71) Applicant: Valeo Lighting Hubei Technical Center Co. Ltd., Wuhan (CN)

(72) Inventors: Jihan Wang, Wuhan (CN); Wenbo Lei, Wuhan (CN); Qingchao Zeng, Wuhan (CN)

(73) Assignee: Valeo Lighting Hubei Technical Center Co. Ltd., Wuhan (CN)

( * ) Notice: Subject to any disclaimer, the term of this patent is extended or adjusted under 35 U.S.C. 154(b) by 54 days.

(21) Appl. No.: 15/963,503

(22) Filed: Apr. 26, 2018

(65) Prior Publication Data

US 2018/0313506 A1 Nov. 1, 2018

(30) Foreign Application Priority Data

Apr. 27, 2017 (CN) ..... 2017 2 0456095 U

(51) Int. Cl.

| | |
|---|---|
| ***F21S 41/29*** | (2018.01) |
| ***F21S 41/24*** | (2018.01) |
| ***F21S 43/14*** | (2018.01) |
| ***F21S 43/241*** | (2018.01) |
| ***F21S 43/243*** | (2018.01) |

(Continued)

(52) U.S. Cl.

CPC ..... *F21S 41/29* (2018.01); *F21S 41/24* (2018.01); *F21S 43/14* (2018.01); *F21S 43/241* (2018.01); *F21S 43/243* (2018.01); *F21S 43/27* (2018.01); *F21W 2103/20* (2018.01)

(58) Field of Classification Search

CPC .. F21S 41/24; F21S 41/29; F21S 41/63; F21S 43/235; F21S 43/236; F21S 43/241; F21S 43/243; F21S 43/27

See application file for complete search history.

(56) References Cited

U.S. PATENT DOCUMENTS 4,422,719 A * 12/1983 Orcutt ..... B29D 11/00711 385/123

9,328,891 B1 5/2016 Dernar et al.

(Continued)

FOREIGN PATENT DOCUMENTS

CN 104964228 A 10/2015

DE 10 2012 109 422 A1 4/2014

(Continued)

OTHER PUBLICATIONS

European Search Report dated Aug. 16, 2018, in European Application No. 18 16 8211, 7 pages.

*Primary Examiner* — Evan P Dzierzynski

*Assistant Examiner* — Keith G. Delahoussaye

(74) *Attorney, Agent, or Firm* — Oblon, McClelland, Maier & Neustadt, L.L.P.

(57) ABSTRACT

A light-transmitting element including a main body and a fixing portion. A connection portion is provided between the main body and the fixing portion, so that the main body is spaced apart from the fixing portion by the connection portion. The present utility model also provides a lighting device including the light-transmitting element. According to the light-transmitting element and the lighting device of the present utility model, it can avoid a fixing structure for fixing the light-transmitting element from being observed from outside.

18 Claims, 5 Drawing Sheets

(51) Int. Cl.
*F21S 43/27* (2018.01)
*F21W 103/20* (2018.01)

(56) References Cited

U.S. PATENT DOCUMENTS

| | | | | |
|---|---|---|---|---|
| 2008/0037771 | A1* | 2/2008 | Black | H04M 1/0266 379/433.01 |
| 2012/0069592 | A1* | 3/2012 | Natsume | B60Q 1/0052 362/511 |
| 2015/0036372 | A1* | 2/2015 | Kohler | B60Q 1/2607 362/511 |
| 2016/0091653 | A1 | 3/2016 | Ban et al. | |
| 2016/0347234 | A1* | 12/2016 | Herbin | F21S 41/24 |

FOREIGN PATENT DOCUMENTS

| | | |
|---|---|---|
| FR | 2 894 321 | 6/2007 |
| JP | 2016-35855 | 3/2016 |
| JP | 2017-41369 | 2/2017 |
| WO | WO 2016/040971 A1 | 3/2016 |

* cited by examiner

LIGHT-TRANSMITTING ELEMENT AND LIGHTING DEVICE INCLUDING THE SAME

BACKGROUND

Technical Field

The present utility model relates to a technical field of motor vehicle, and more particularly, to a light-transmitting element and a lighting device including the light-transmitting element.

Description of the Related Art

A light-transmitting element, such as a light guide, is often used as an optical element in a lighting device of a motor vehicle. The light guide is a structural member that directs light emitted by a light source to a desired position. It allows the light to be internally transmitted in the light guide by a total reflection of light. The light guide is generally made of a transparent PC material or PMMA material. In the design of the lighting device, it involves fixing of the light guide. Due to transparency of the light guide, a fixing structure for fixing the light guide can be observed from outside, which adversely affects aesthetic appearance of the lighting device. Furthermore, during an operation of the light guide, abnormal light spots may be observed from a light exit side of the light guide, and the abnormal light spots will severely destroy a style design of the lighting device.

SUMMARY

An object of the present utility model is to provide a light-transmitting element that can avoid a fixing structure for fixing it in a lighting device from being observed from outside, so as to overcome the drawbacks in the prior art.

Another object of the present utility model is to provide a light-transmitting element that has a simple structure and is easily to be manufactured.

A further object of the present utility model is to provide a lighting device that makes style design more stable.

In order to achieve at least one of the above objects, the technical solutions of the present utility model are provided as follows:

According to an aspect of the present utility model, there is provided a light-transmitting element comprising a main body and a fixing portion, wherein a connection portion is provided between the main body and the fixing portion, so that the main body is spaced apart from the fixing portion by the connection portion.

According to a preferred embodiment of the present utility model, a dimension of the connection portion in a direction parallel to a light-exiting direction of the light-transmitting element is less than a dimension of the fixing portion in the same direction.

According to a preferred embodiment of the present utility model, the connection portion comprises an L-shaped connection portion having an L-shaped cross section perpendicular to a longitudinal direction of the L-shaped connection portion.

According to a preferred embodiment of the present utility model, the L-shaped connection portion comprises a first portion and a second portion, which is substantially perpendicular to the first portion, the first portion being connected to the main body and the second portion being connected to the fixing portion, and the second portion extends from the first portion in a direction away from a light-exiting surface side of the light-transmitting element.

According to a preferred embodiment of the present utility model, the first portion of the L-shaped connection portion is vertically connected to the main body at a middle position of a lower surface of the main body.

According to a preferred embodiment of the present utility model, the L-shaped connection portion substantially extends along the whole length of the main body.

According to a preferred embodiment of the present utility model, the main body, the fixing portion and the L-shaped connection portion are integrally formed into a one piece.

According to a preferred embodiment of the present utility model, the light-transmitting element comprises a light guide.

According to a preferred embodiment of the present utility model, the light guide is a flat light guide having a bending portion.

According to a preferred embodiment of the present utility model, the light-transmitting element further comprises a fixing groove configured to be engaged with a fixing protrusion provided on a component supporting the light-transmitting element.

According to a preferred embodiment of the present utility model, the fixing portion comprises a screw boss.

According to a preferred embodiment of the present utility model, the light-transmitting element comprises two to five screw bosses.

According to a preferred embodiment of the present utility model, the L-shaped connection portion comprises a frosted surface located at an inner side of the L shape.

According to a preferred embodiment of the present utility model, the connection portion has a T-shaped, C-shaped, J-shaped or S-shaped cross section perpendicular to a longitudinal direction of the connection portion.

According to another aspect of the present utility model, there is also provided a lighting device comprising the light-transmitting element according to any one of the foregoing embodiments.

The present utility model provides a light-transmitting element, especially a light guide, which comprises a main body, a fixing portion and a connection portion arranged between the main body and the fixing portion. By means of the design of connection portion, it can avoid a fixing structure for fixing the light-transmitting element in a lighting device from being observed from outside. Advantageously, a dimension of the connection portion in a direction parallel to a light-exiting direction of the light-transmitting element is less than a dimension of the fixing portion in the same direction, thereby further limiting propagation of light in the connection portion, to prevent the fixing portion from being observed from the outside. Further, the connection portion comprises an L-shaped connection portion having an L-shaped cross section perpendicular to a longitudinal direction of the L-shaped connection portion. Specifically, the L-shaped connection portion comprises a first portion and a second portion, which is substantially perpendicular to the first portion, the first portion being connected to the main body and the second portion being connected to the fixing portion, and the second portion extends from the first portion in a direction moving away from a light-exiting surface side of the light-transmitting element. By providing the L-shaped connection portion between the main body and the fixing portion, the light emitted from the light source enters the light guide, most of the light exits from a light-exiting surface side (opposite to the light source) through a total reflection in the main body, and a small portion of the light will propagate along the first portion of the L-shaped connection portion away from the light-exiting surface side even if it is reflected in the L-shaped connection portion, thus it will not enter a human eye at the light-exiting surface side. Therefore, the specific shape and structure of the L-shaped connection portion will not be seen by the human eye. Additionally, since the second portion extends from the first portion in a direction away from the light-exiting surface side of the light-transmitting element, the reflected light from the first portion hardly enters the second portion, and it is more difficult for this reflected light to enter the fixing portion. In this way, the light will not be reflected by the second portion and the fixing portion, so that the second portion of the L-shaped connection portion and the fixing portion carried by the second portion will not be seen by the human eye.

It can be seen that, the present utility model provides a light-transmitting element that can avoid the fixing structure for fixing the light-transmitting element from being observed from the outside. Further, by means of the light-transmitting element, no light spot will be generated outside of the lighting device, and thus the style design for the lighting device will not be adversely affected, thereby making the lighting device more beautiful and making the style design more stable.

DETAILED DESCRIPTION OF PREFERRED EMBODIMENTS

Figure 1:
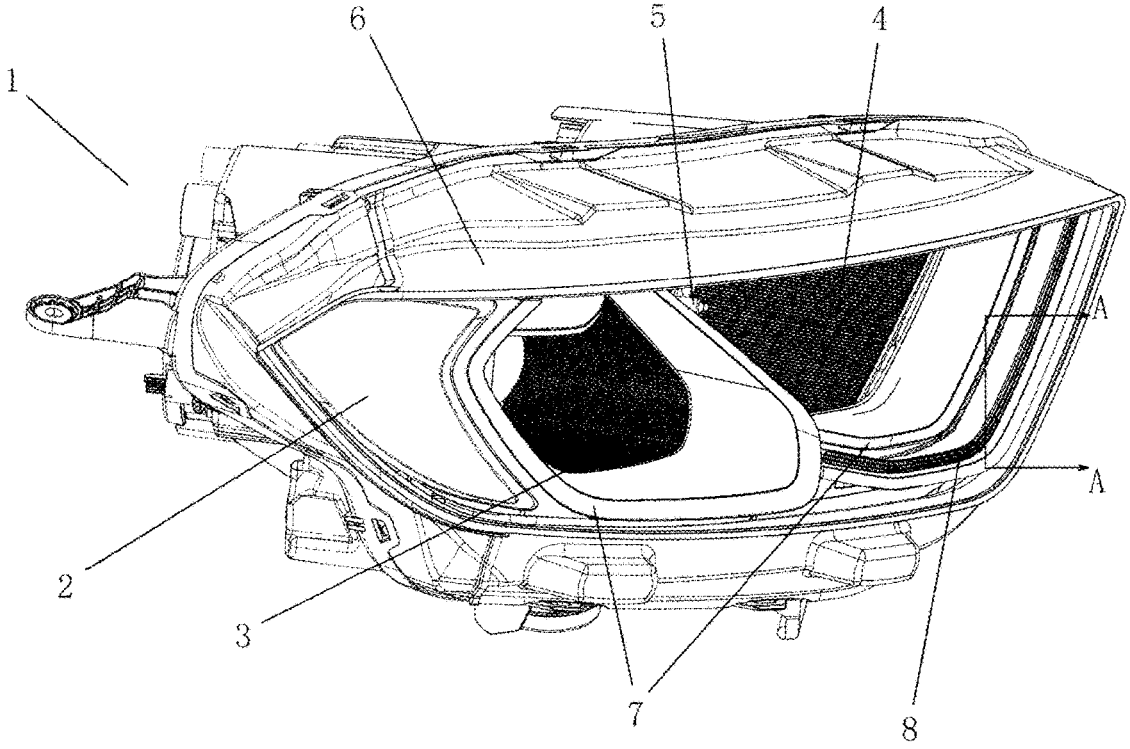
FIG. 1 is a schematic view of a lighting device according to an embodiment of the present utility model.

Exemplary embodiments of the present utility model will be described in detail below with reference to the accompanying drawings in which the same or similar reference numerals represent the same or similar elements. In addition, in the following detailed description, numerous specific details are set forth in order to facilitate the explanation and provide a thorough understanding of the embodiments of the present disclosure. However, it will be apparent that the embodiment(s) may also be practiced without these specific details. In other cases, well-known structures and devices are schematically illustrated to simplify the drawings.

According to a general inventive concept of the present utility model, it provides a light-transmitting element comprising a main body and a fixing portion, a connection portion is provided between the main body and the fixing portion, so that the main body is spaced apart from the fixing portion by the connection portion. By means of the design of connection portion, it can avoid a fixing structure for fixing the light-transmitting element in a lighting device from being observed from outside. Advantageously, a dimension of the connection portion in a direction parallel to a light-exiting direction of the light-transmitting element is less than a dimension of the fixing portion in the same direction, thereby further limiting propagation of light in the connection portion, to prevent the fixing portion from being observed from the outside.

Next, the present disclosure will be described by taking a headlight of a motor vehicle as an example. FIG. 1 is a schematic view of a lighting device 1 according to an embodiment of the present utility model. As shown in FIG. 1, the lighting device (headlight) 1 comprises: a housing 6, and a first light source 5, a reflector 4, an inner lens 2, an outer lens 3 and a light guide 8 directly or indirectly fixed to the housing 6. The first light source 5, the reflector 4 and the outer lens 3 and the like are used to form an illumination light path. The inner lens 2 is different from the outer lens 3 and is disposed at an inner side of the outer lens 3 with respect to a central axis of the vehicle, and the inner lens 2 mainly functions as decoration and light distribution. The outer lens 3 and the inner lens 2 are each made of a light-transmitting material. The light guide 8 is arranged in the lighting device 1 close to the outside of the lighting device 1, for guiding the light from the light source to form for example a signaling light, such as a turn light. Between the outer lens 3 and the inner lens 2 and besides the light guide, transition plates 7 are provided for functioning as decoration and fixing, and the transition plates 7 are made of a non-light-transmitting material.

Figure 2:
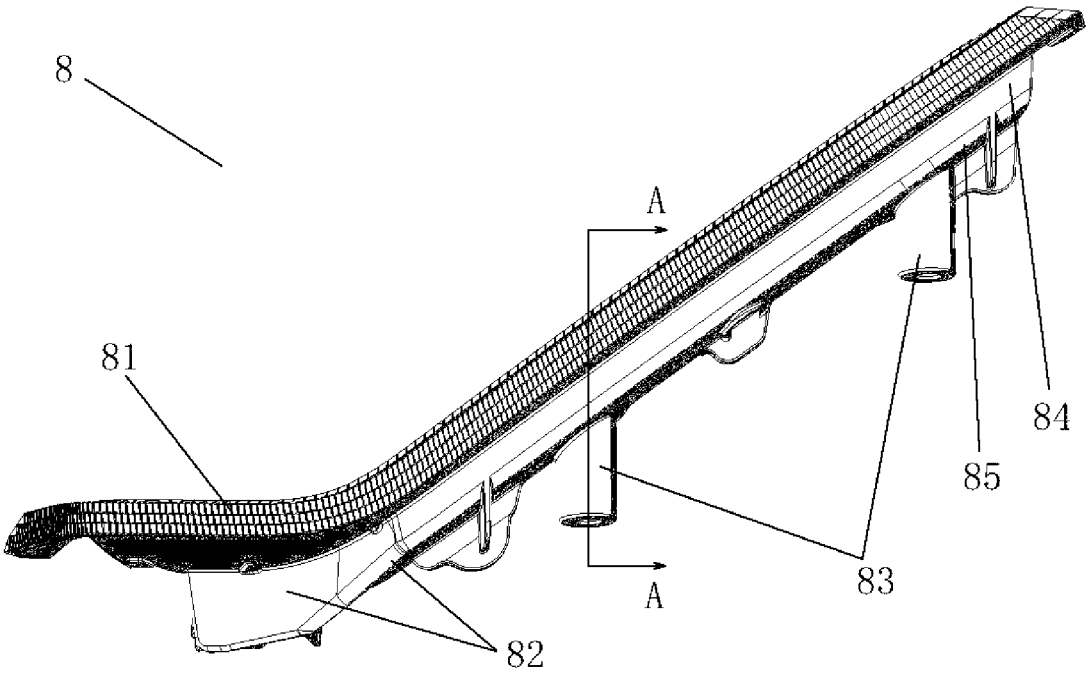
FIG. 2 is a front view of a light guide according to an embodiment of the present utility model.
Figure 3:
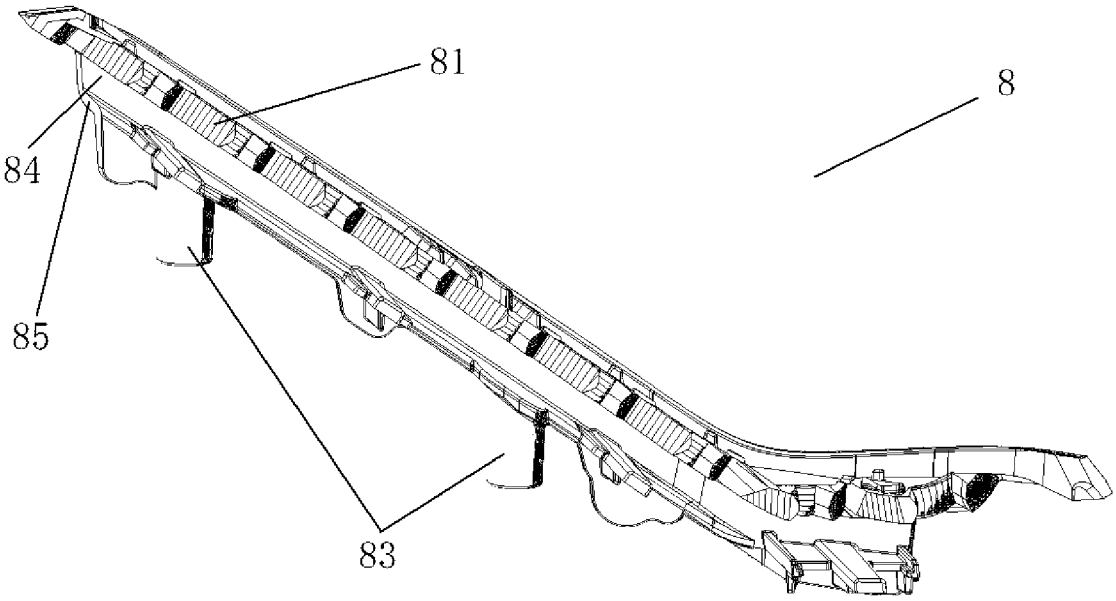
FIG. 3 is a rear view of a light guide according to an embodiment of the present utility model; Fig.
Figure 4:
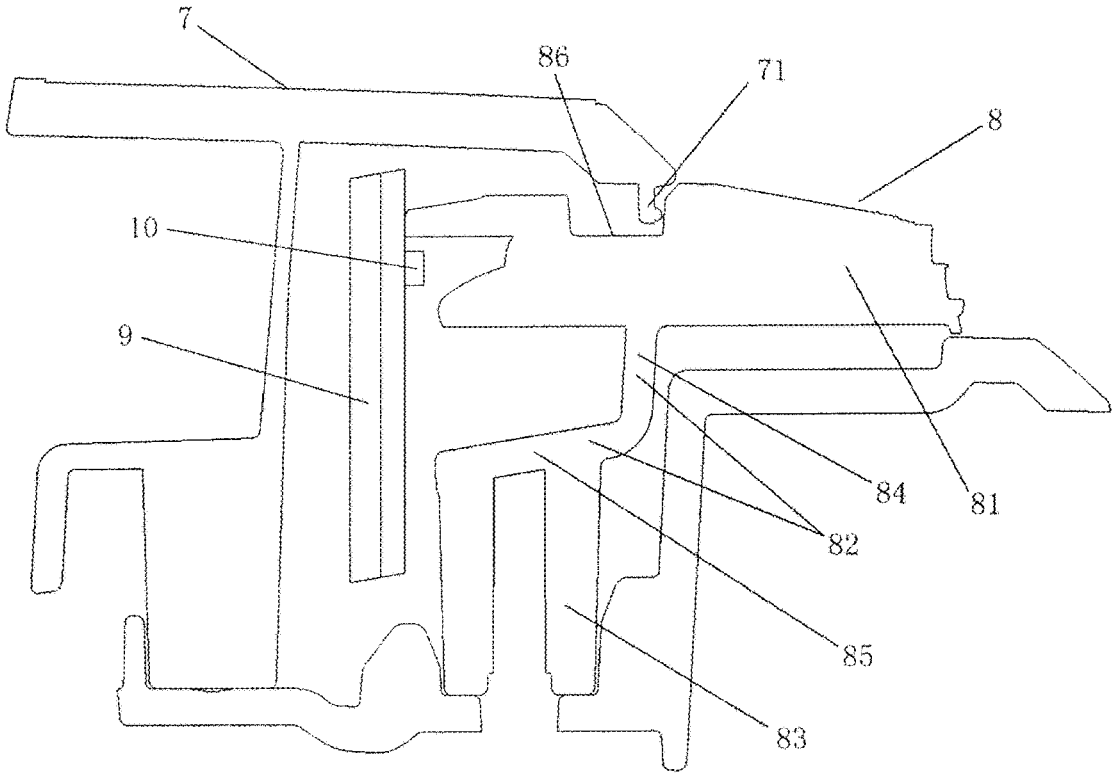
FIG. 4 is a schematic cross-sectional view of the lighting device taken along a line A-A of FIG. 1 or a line A-A of FIG. 2.

FIGS. 2 and 3 illustrate the light guide 8 according to the embodiment of the present utility model. The light guide 8 is a flat light guide having a bending portion. The light guide 8 according to this embodiment may be made of a transparent PC material, a PMMA material, or any other transparent materials. The light guide 8 includes a light guide main body 81, an L-shaped connection portion 82 and a fixing screw boss 83; in an example, the light guide main body 81 has a substantially flat shape with a bending portion to fit the overall shape design of the lighting device. As shown in FIG. 2, one side of the light guide main body 81 close to a viewer is a light-exiting surface side, and the other side facing away from the viewer is a light entrance surface side, and the L-shaped connection portion is provided on a lower surface of the flat light guide main body 81. The cross section of the L-shaped connection portion 82 perpendicular to a longitudinal direction of the L-shaped connection portion 82 is L-shaped (shown in FIG. 4), and the L-shaped connection portion 82 substantially extends along the whole main body 81. As shown in FIG. 4, a dimension of the L-shaped connection portion 82 in a direction parallel to a light-exiting direction (a horizontal rightward direction in FIG. 4) of the light-transmitting element 8 is less than a dimension of the fixing screw boss 83 in the same direction, thereby further limiting propagation of light in the L-shaped connection portion 82, to prevent the fixing portion from being observed from the outside.

As shown in FIGS. 2-4, the L-shaped connection portion 82 includes a first portion 84 and a second portion 85 substantially perpendicular to each other. The first portion 84 is connected to the light guide main body 81, the second portion 85 is connected to the fixing screw boss 83, and the second portion 85 extends from the first portion 84 in a direction away from the light-exiting surface side of the light guide main body 81. The fixing screw boss 83 is provided on the second portion 85 of the L-shaped connection portion 82, for fixing the light guide 8 in the lighting device 1 by screws. In a preferred embodiment, the first portion 84 of the L-shaped connection portion 82 is vertically connected to the light guide main body 81 at a middle position of a lower surface of the light guide main body 81, as shown in FIG. 4.

It should be noted that, according to the embodiment of the present utility model, the light guide main body 81, the fixing screw boss 83, and the L-shaped connection portion 82 are integrally formed as a one piece, and they are made of a same material to form a hollow transparent member.

In the cross-sectional view of FIG. 4, the cross section of the lighting device 1 taken along line A-A of FIG. 1 or line A-A of FIG. 2 is shown, and a second light source 10 and a printed circuit board 9 are shown. The second light source 10 is arranged at a light entrance surface side of the light guide 8. The printed circuit board 9 is configured for fixing the second light source 10 and providing power and control signals to the second light source 10. The operation principle of the light guide 8 will be described below with reference to FIG. 4. A fixing groove 86 is provided in the top of the light guide main body 81 of the light guide 8. The fixing groove 86 is configured to be engaged with a fixing protrusion 71 provided on the transition plate 7 supporting the light guide. In addition, the light guide 8 is fixed to a light guide holder (located below the light guide 8) by its fixing screw boss 83. In this way, the light guide 8 is fixedly mounted. During the operation of the lighting device 1, the light emitted from the second light source 10 enters the light guide main body 81 through a light entrance surface of the light guide 8, and the light is totally reflected in the hollow light guide main body 81, and then exits from the light-exiting surface side (right hand side in FIG. 4) of the light guide 8.

Figure 5:
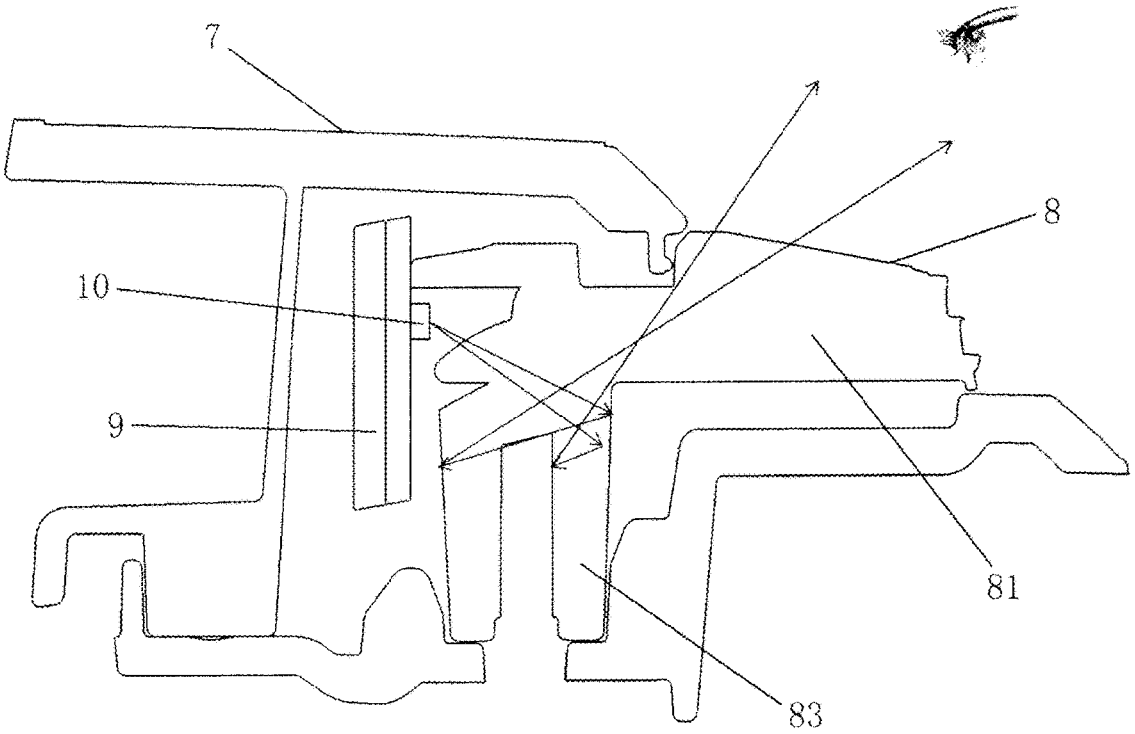
FIG. 5 is a schematic cross-sectional view of the lighting device in which a fixing screw boss of a light guide is observed, without any L-shaped connection portion.
Figure 6:
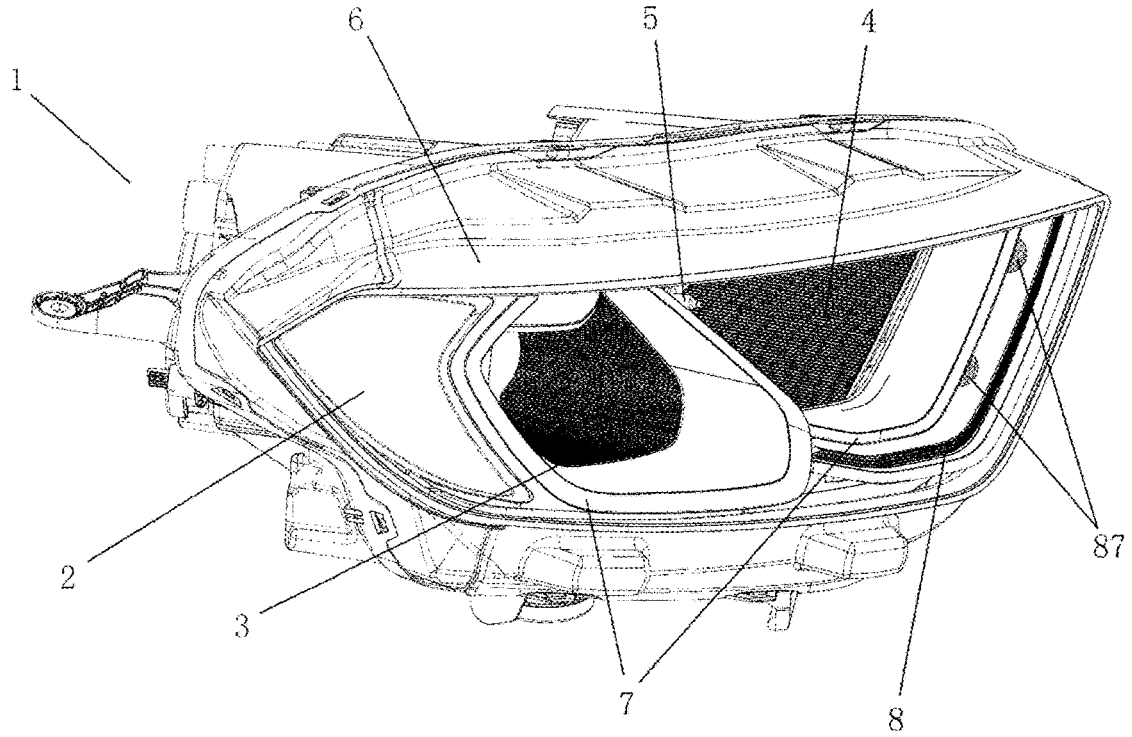
FIG. 6 is a schematic view of the lighting device shown in FIG. 5, without any L-shaped connection portion.

In order to describe the effect of the light guide according to the embodiment of the present utility model, a reference example is given here. Referring to FIG. 5, the light guide 8 in FIG. 5 includes only the light guide main body 81 and the fixing screw boss 83. Compared with the embodiment shown in FIG. 4, the light guide 8 in FIG. 5 does not have any L-shaped connection portion. Since there is no L-shaped connection portion provided according to the present utility model, a portion of the light emitted from the second light source 10 enters the light guide main body 81, and another portion of the light enters the hollow fixing screw boss 83 and is reflected by the fixing screw boss 83. As shown in the figure, the reflected light can be emitted from the light-exiting surface side of the light guide 8, therefore an observer located in front of the vehicle and in front of the lighting device can observe the structure of the fixing screw boss, which leads to reduced aesthetic appearance of the lighting device. FIG. 6 is a schematic view of a lighting device using the light guide of FIG. 5. It can be seen from the figure that, when the structure of the L-shaped connection portion of the present utility model is not adopted, abnormal light spots 87 appear nearby the light guide 8, which is undesirable because it destroys the lighting layout of the lighting device 1.

Figure 7:
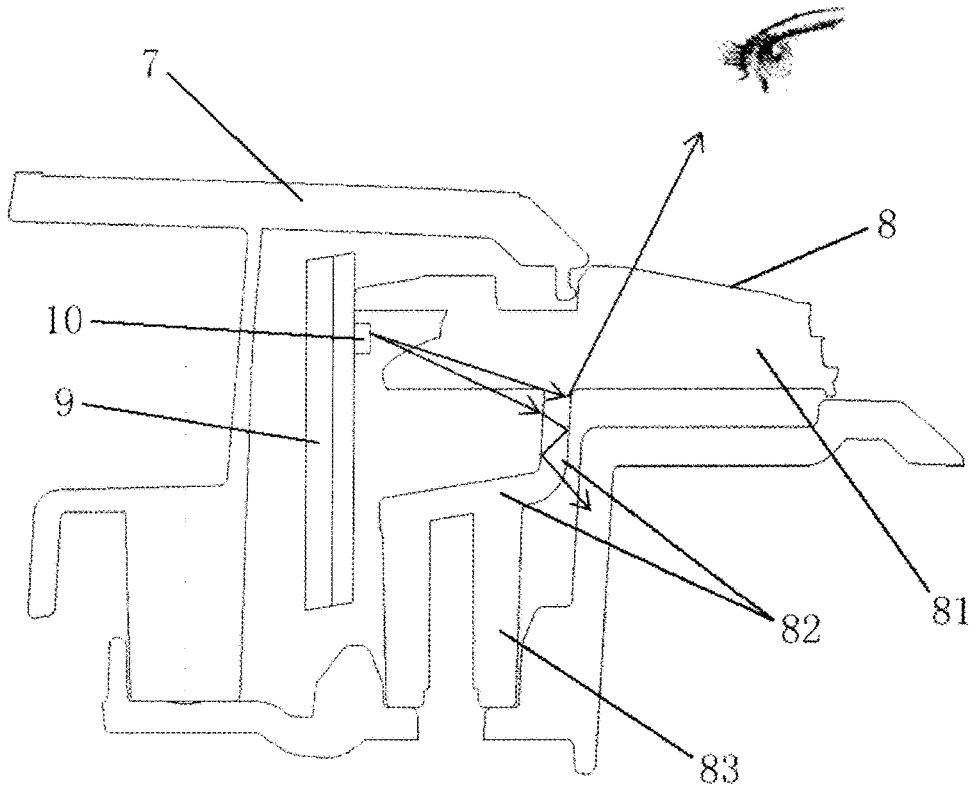
FIG. 7 is a schematic cross-sectional view of the lighting device in which a fixing screw boss of a light guide is not observed, the light guide being a light guide provided according to an embodiment of the present utility model.

In contrast, the light guide 8 provided by the present utility model comprises the light guide main body 81, the fixing screw boss 83 and the L-shaped connection portion 82 arranged between the light guide main body 81 and the fixing screw boss 83, and the cross section of the L-shaped connection portion 82 perpendicular to a longitudinal direction of the L-shaped connection portion 82 is L-shaped. Specifically, the L-shaped connection portion 82 comprises a first portion 84 and a second portion 85, which is substantially perpendicular to the first portion 84, the first portion 84 being connected to the light guide main body 81 and the second portion 85 being connected to the fixing screw boss 83, and the second portion 85 extends from the first portion 84 in a direction away from a light-exiting surface side of the light guide 8. FIG. 7 shows the operation principle in which the fixing screw boss of the light guide according to the present utility model could not be observed. By providing the L-shaped connection portion 82 between the light guide main body 81 and the fixing screw boss 83, the light emitted from the second light source 10 enters the light guide 8, most of the light exits from a light-exiting surface side (opposite to the second light source 10) through a total reflection in the light guide main body 81, and a small portion of the light will propagate along the first portion 84 of the L-shaped connection portion 82 away from the light-exiting surface side even if it is reflected in the L-shaped connection portion 82, thus it will not enter a human eye at the light-exiting surface side. Therefore, the specific shape and structure of the L-shaped connection portion 82 will not be seen by the human eye. Additionally, since the second portion 85 extends from the first portion 84 in a direction away from the light-exiting surface side of the light guide 8, the reflected light from the first portion 84 hardly enters the second portion 85, and it is more difficult for this reflected light to enter the hollow fixing screw boss 83. In this way, the light will not be reflected by the second portion 85 and the fixing screw boss 83, so that the second portion 85 of the L-shaped connection portion 82 and the fixing screw boss 83 carried by the second portion will not be seen by the human eye.

It can be seen that, the present utility model provides a light guide that can avoid the fixing structure for fixing the light guide from being observed from the outside. Further, by means of the light guide, no light spot will be generated outside of the lighting device, and thus the style design for the lighting device will not be adversely affected, thereby making the lighting device more beautiful and making the style design more stable.

Figure 8:
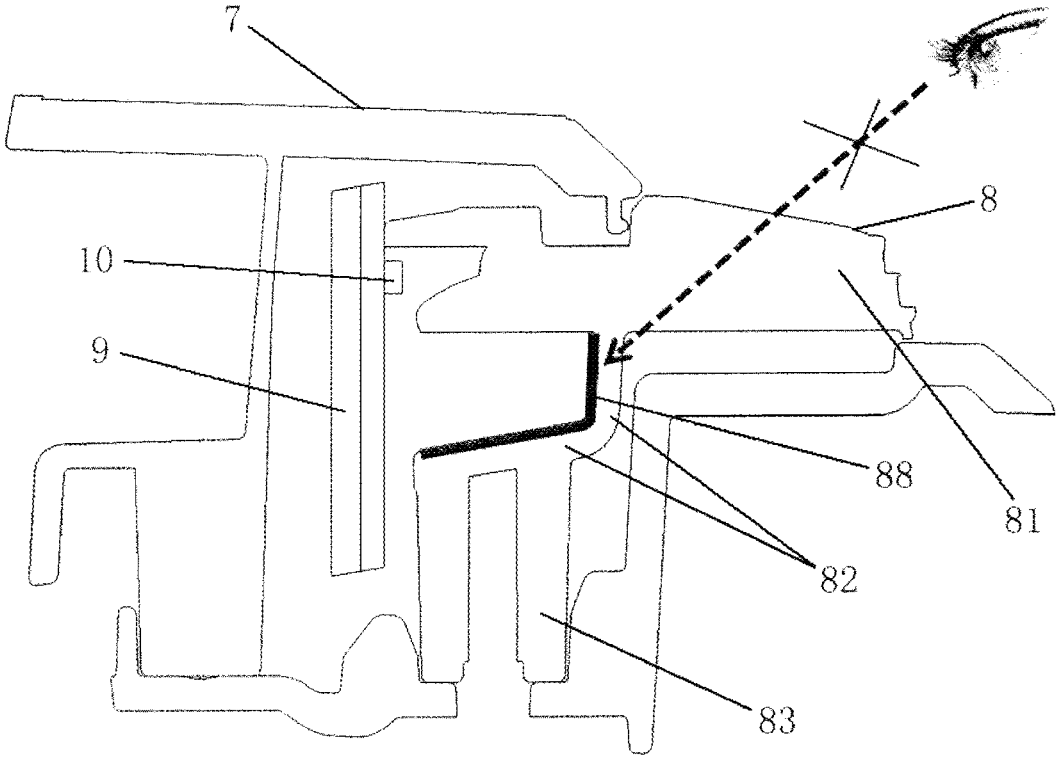
FIG. 8 is a schematic cross-sectional view of a lighting device according to another embodiment of the present utility model.

FIG. 8 shows another embodiment of a light guide according to the present utility model. The L-shaped connection portion 82 is provided with a graining or frosted surface 88, and the frosted surface 88 is located at an inner side of the L shape. The frosted surface 88 blocks the human eye from seeing the structure behind the graining surface, and the frosted surface suppresses the reflection on the L-shaped connection portion, thereby further suppressing the visibility of the fixing structure of the light guide.

It should be noted that the connection portion according to the present utility model may also have a T-shaped, C-shaped, J-shaped or S-shaped cross section perpendicular to a longitudinal direction of the connection portion, which will not be limited in the present utility model.

In addition, the present utility model further provides a lighting device comprising a light guide, which is the light guide described according to any one of the preceding embodiments.

While the embodiments of the present utility model have been shown and described, variations and modifications may be made to these embodiments by those skilled in the art without departing from the principles and spirit of the present utility model. The scope of the present utility model is defined by the appended claims and equivalents thereof.

REFERENCE NUMERAL LIST

1 lighting device
2 inner lens
3 outer lens
4 reflector
5 first light source
6 housing
7 transition plate
71 fixing protrusion
8 light guide
81 light guide main body
82 L-shaped connection portion
83 fixing screw boss
84 first portion
85 second portion
86 fixing groove
87 light spot
88 frosted surface
9 printed circuit board
10 second light source

What is claimed is:

1. A light-transmitting element comprising a main body and a fixing portion, wherein a connection portion is provided between the main body and the fixing portion, so that the main body is spaced apart from the fixing portion by the connection portion, wherein the connection portion comprises an L-shaped connection portion having an L-shaped cross section perpendicular to a longitudinal direction of the L-shaped connection portion, and wherein the L-shaped connection portion is arranged to propagate a portion of light from the light-transmitting element away from a light-exiting direction of the light-transmitting element such that shape and structure of the connection portion cannot be seen in the exiting light, wherein the fixing portion comprises a screw boss.

2. The light-transmitting element according to claim 1, wherein a dimension of the connection portion in a direction parallel to a light-exiting direction of the light-transmitting element is less than a dimension of the fixing portion in the same direction.

3. The light-transmitting element according to claim 2, wherein the light-transmitting element comprises a light guide.

4. The light-transmitting element according to claim 2, wherein the light-transmitting element further comprises a fixing groove configured to be engaged with a fixing protrusion provided on a component supporting the light-transmitting element.

5. The light-transmitting element according to claim 1, wherein the L-shaped connection portion comprises a first portion and a second portion, which is substantially perpendicular to the first portion, the first portion being connected to the main body and the second portion being connected to the fixing portion, and the second portion extends from the first portion in a direction away from a light-exiting surface side of the light-transmitting element.

6. The light-transmitting element according to claim 5, wherein the first portion of the L-shaped connection portion is vertically connected to the main body at a middle position of a lower surface of the main body.

7. The light-transmitting element according to claim 5, wherein the L-shaped connection portion comprises a frosted surface located at an inner side of the L shape.

8. The light-transmitting element according to claim 1, wherein the L-shaped connection portion substantially extends along the whole length of the main body.

9. The light-transmitting element according to claim 1, wherein the main body, the fixing portion and the L-shaped connection portion are integrally formed into a one piece.

10. The light-transmitting element according to claim 1, wherein the light-transmitting element comprises a light guide.

11. The light-transmitting element according to claim 10, wherein the light guide is a flat light guide having a bending portion.

12. The light-transmitting element according to claim 1, wherein the light-transmitting element further comprises a fixing groove configured to be engaged with a fixing protrusion provided on a component supporting the light-transmitting element.

13. The light-transmitting element according to claim 1, wherein the light-transmitting element comprises two to five screw bosses.

14. The light-transmitting element according to claim 1, wherein the L-shaped connection portion comprises a frosted surface located at an inner side of the L shape.

15. The light-transmitting element according to claim 1, wherein the connection portion has a T-shaped, C-shaped, J-shaped or S-shaped cross section perpendicular to a longitudinal direction of the connection portion.

16. A lighting device comprising the light-transmitting element according to claim 1.

17. A light-transmitting element comprising a main body and a fixing portion, wherein a connection portion is provided between the main body and the fixing portion, so that the main body is spaced apart from the fixing portion by the connection portion, wherein a dimension of the connection portion in a direction parallel to a light-exiting direction of the light-transmitting element is less than a dimension of the fixing portion in the same direction, and wherein the fixing portion comprises a screw boss.

18. A lighting device comprising the light-transmitting element according to claim 2.

* * * * *